US005706523A

United States Patent [19]

Witzel

[11] Patent Number: 5,706,523

[45] Date of Patent: Jan. 13, 1998

[54] LOWER BODY GARMENT APPARATUS

[76] Inventor: Marshall Witzel, 2445 Hybernia Dr., Highland Park, Ill. 60035-5510

[21] Appl. No.: 610,363

[22] Filed: Mar. 4, 1996

[51] Int. Cl.[6] ..... A41D 13/00

[52] U.S. Cl. ..... 2/238; 2/465; 2/467; 2/23; 2/227

[58] Field of Search ..... 2/2, 22, 23, 227, 2/238, 464, 465, 467, 400, 403, 408, 215, 228, 235, 267

[56] References Cited

U.S. PATENT DOCUMENTS

| | | | |
|---|---|---|---|
| Re. 26,360 | 3/1968 | Pagano | 2/227 |
| 1,612,766 | 1/1927 | Levinson | 2/22 |
| 1,667,363 | 4/1928 | Wagner | 2/227 |
| 1,944,127 | 1/1934 | Jones | 2/23 |
| 2,292,227 | 8/1942 | Kopyto | 2/22 |
| 4,258,440 | 3/1981 | McGowan | 2/238 |
| 4,302,847 | 12/1981 | Miles | 2/2 |
| 4,807,301 | 2/1989 | Ferber | 2/2 |
| 4,894,867 | 1/1990 | Ceravolo et al. | 2/238 |
| 5,008,962 | 4/1991 | Smith et al. | 2/227 |
| 5,134,726 | 8/1992 | Ross | 2/22 |
| 5,161,257 | 11/1992 | Arensdorf et al. | 2/22 |
| 5,315,716 | 5/1994 | Baum | 2/227 |
| 5,497,511 | 3/1996 | Zade | 2/238 |

FOREIGN PATENT DOCUMENTS

| | | | |
|---|---|---|---|
| 2043463 | 3/1971 | Germany | 2/23 |

*Primary Examiner*—Amy B. Vanatta
*Attorney, Agent, or Firm*—Dick and Harris

[57] ABSTRACT

A lower body garment apparatus for a patient, which protects a lower region of the patient while facilitating dress, undress and accessibility to the lower region of said patient, with minimal movement and reorientation of said patient, to, in turn, minimize the risk of trauma and injury to the patient, comprises a front panel, an encircling panel, two attachment members and a padded member. The front panel includes two side edges and covers a lower front region of a patient. The encircling panel includes two side edges and likewise extends around at least one of a right and left hip region and at least a portion of a lower rear region of a patient. Attachment members releasably attach the front panel side edges to the encircling panel at either side edges of the encircling panel. The padded member overlays at least a portion of the outer surface of the encircling panel to provide padding for at least a portion of one of the right and left hip regions and at least a portion of the lower rear region of the patient.

13 Claims, 1 Drawing Sheet

LOWER BODY GARMENT APPARATUS

BACKGROUND OF THE INVENTION

The present invention relates in general to a medical garment and, more particularly, to a lower body garment apparatus for a patient which protects the lower rear region of a patient while facilitating dress, undress and accessibility to the lower region of the patient, with minimal movement and reorientation of the patient, thus minimizing risk of trauma and injury to the patient.

The use of medical garments for patients who are to be bedridden or who are not capable of much movement has been known in the art. These medical garments are generally of the type that may protect certain portions of the body of the patient. Others are of the type that are easy to remove and to replace on the patient. Many of the medical garments used with such patients which are intended to protect certain regions of the patient, such as, for example, the hips and the lower rear region, are quite cumbersome. To a patient capable of only limited movement, a cumbersome garment renders dressing, undressing and even mere access to the lower body region quite difficult. As such, any protective capabilities are outweighed by the cumbersome nature of the garment.

Other garments have been developed facilitate dress, undress and access to lower body regions of a patient. These garments are generally one ply, thin gowns, commonly referred to as hospital gowns. No padding is provided with such gowns, and consequently there is little protection for the lower region of a patient when sitting or lying in bed. Further, this garment is quite different than the type of garment the patient normally wears, rendering it uncomfortable and even embarrassing.

Accordingly, it is an object of the present invention to provide for a lower body garment apparatus which is padded to protect the patient, while minimizing the bulkiness of the garment, and the extent to which the garment is cumbersome.

It is still a further object of the present invention to provide for a lower body garment apparatus which facilitates the dress and undress of the patient, as well as access to lower body regions of the patient, without having to substantially alter the position of the patient.

It is still a further object of the present invention to provide a lower body garment apparatus that retains a style of dress to which the patient is familiar, to facilitate comfort of the patient.

These and other features of the present invention will become apparent in light of the present specification, drawings and claims.

SUMMARY OF THE INVENTION

The present invention is directed to a lower body garment apparatus for a patient. The patient includes a lower region between the waist and the thigh of the patient. The lower region includes at least one right and left hip region, a lower rear region and a lower front region. The lower body apparatus protects the lower region of the patient while facilitating dress, undress and accessibility to the lower region of the patient with minimal movement and reorientation of the patient, to, in turn, minimize the risk of trauma and injury to the patient.

The lower body garment apparatus comprises a front panel, an encircling panel, a first releasable attaching means, a second releasable attaching means and a padded member.

The front panel includes a right edge, a left edge, a top edge and a bottom edge. The front panel is configured to cover at least a portion of said lower front region of the patient.

The encircling panel includes a first edge, a second edge, an inner surface, an outer surface, an upper edge and a lower edge. The encircling panel extends around at least one of the right and left hip regions, and further extends around at least a portion of the lower rear region of the patient.

The first releasable attachment means releasably attaches the right edge of the front panel to the first edge of the encircling panel. The second releasable attachment means releasably attaches the left edge of the front panel to the second edge of the encircling panel.

The padded member is operably attached to at least a portion of at least one of the inner and outer surfaces of the encircling panel so as to provide padding for at least a portion of at least one of the right and left hip regions, and to at least a portion of the lower rear region.

In the preferred embodiment, the front panel further comprises an inner leg region and the encircling panel further comprises a third edge region. The inner leg region of the front panel is operably attached to the third edge region of the encircling panel to define a crotch region.

In this preferred embodiment, the top edge of the front panel is aligned and registered with the upper edge of the encircling panel wherein, one of the top edge of the front panel and the upper edge of the encircling panel includes an elastic member associated therewith. The elastic member facilitates a comfortable fit of the apparatus around the waist of the patient. Further, the upper edge of the front panel and the top edge of the encircling panel are oriented for alignment with the waist of the patient.

In one such embodiment, the padded member is operably attached to the outer surface of the encircling panel and extends continuously from the first edge of the encircling panel to the second edge of the encircling panel to provide padding to at least one of the right and left hip regions, and to at least a portion of the lower rear region. In such a preferred embodiment, the padded member extends from the upper edge of the encircling member to substantially midway between the upper edge and the lower edge of the encircling member. In another preferred embodiment, the padded member is operably attached to the inner surface of the encircling panel.

Preferably, the padded member further includes an outer layer of material covering at least a portion of the padded member. The outer layer of material operably restrains the padded member and enhances the durability of same. The outer layer of material may comprise a fabric which resists the absorption of fluids therethrough, to minimize the exposure to and the absorption of such fluids by the padded member.

In this preferred embodiment, the first releasable attachment means comprises a first zipper. The first zipper includes a first set of teeth attached to the right edge of the front panel and a second set of teeth matingly corresponding to the first set of teeth. The second set of teeth is attached to the first edge of the encircling panel. The first zipper facilitates attachment and detachment of the front panel from the first edge of the encircling member. The second releasable attachment means comprises a second zipper. The second zipper includes a first set of teeth attached to the left edge of the front panel and a second set of teeth matingly corresponding to the first set of teeth. The second set of teeth is attached to the second edge of the encircling panel. The second zipper facilitates attachment and detachment of the front panel from the second edge of the encircling panel.

DETAILED DESCRIPTION OF THE DRAWINGS

Figures 1, 2, 3:
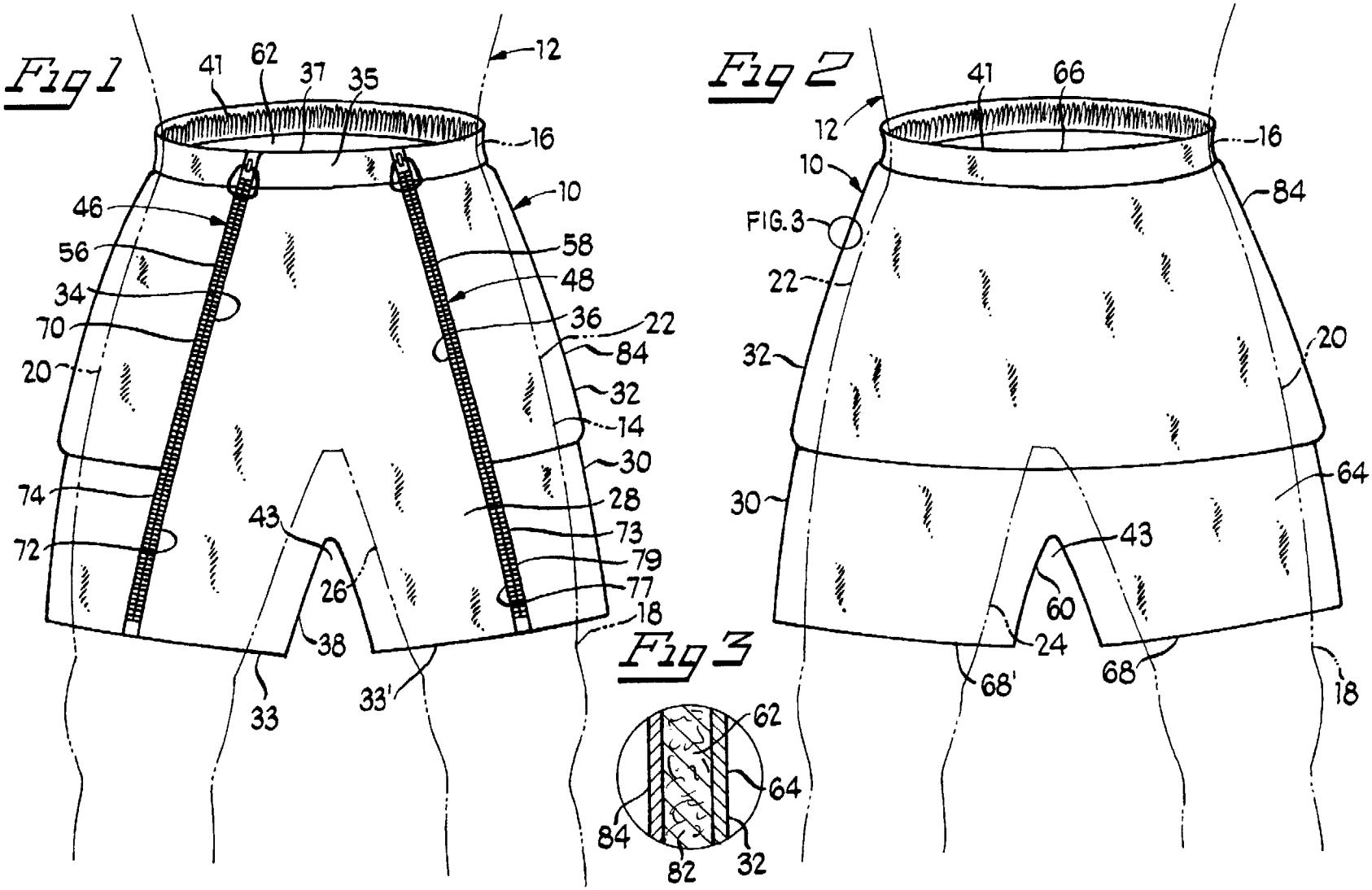
FIG. 1 of the drawings is a front plan view of the present lower body garment apparatus, showing, in particular, a patient wearing same.
FIG. 2 of the drawings is a rear plan view of the present lower body garment apparatus.
FIG. 3 of the drawings is an enlarged cross-section taken of the upper region of the present garment apparatus of FIG. 2, showing, in particular, the padding and outer layer of material.

While this invention is susceptible of embodiment in many different forms, there is shown in the drawings, and will herein be described in detail, one specific embodiment, with the understanding that the present disclosure is to be considered as an exemplification of the principles of the invention and is not intended to limit the invention to the embodiment illustrated.

Lower body garment apparatus 10 for patient 12 is shown in FIGS. 1 and 2 as comprising front panel 28, encircling member 30, first attachment means 46, second attachment means 48 and padded member 32. Patient 12 includes lower region 14, which extends between waist 16 and thigh 18 and includes right hip region 20, left hip region 22, lower rear region 24 and lower front region 26.

As can be seen in FIGS. 1 and 2, front panel 28 includes right edge 34, left edge 36, a top edge 37, bottom edge 33, 33', first elastic member 35, and inner leg edge region 38. Top edge 37 extends from right edge 34 to left edge 36 along waist 16 of the patient. Bottom edge 33, 33', extends from right edge 34 to left edge 36, opposite top edge 37. Lower leg edge region 38 comprises a v-type cut extending upward from bottom edge 33, 33', substantially between right edge 34 and left edge 36. First elastic member 35 extends along top edge 37 between right edge 34 and left edge 36. First elastic member 35 serves to facilitate a proper fit and to limit any inadvertent, undesirable movement of lower body garment apparatus 10 when on patient 12. As shown, front panel 28 covers a portion of the lower front region of the patient. Preferably, the front panel is constructed from a polyester/cotton material having good durability and breathability characteristics, however other materials and fabrics of both natural and artificial fibers is also contemplated.

Encircling panel 30 is shown in FIGS. 1 and 2 as including first edge 56, second edge 58, third edge region 60, upper edge 66, second elastic member 41, lower edge 68, 68', inner surface 62 and outer surface 64. Upper edge 66 extends from first edge 56 around to second edge 58, co-linearly with top edge 37 of front panel 28. Lower edge 68, 68' likewise extend from first edge 56 around to second edge 58, substantially co-linearly with bottom edge 33, 33'. Third edge region 60 comprises a v-cut region similar to inner leg edge region 38. Inner leg edge region 38 is operably attached to third edge region 60 of encircling panel 30 to define crotch region 43. Second elastic member 41 extends along upper edge 66, between first edge 56 and second edge 58 of encircling panel 30. Indeed, as seen, encircling panel 30 extends around right hip region 20, left hip region 22 and lower rear region 24. Encircling panel 30 is constructed from materials similar to those used to construct front panel 28.

First releasable attaching means 46 comprises first zipper 70 having a first set of teeth 72 and a second set of teeth 74. First set of teeth 72 are attached to right edge 34 of front panel 28. Second set of teeth 74 are matingly corresponding to first set of teeth 72 and are attached to first edge 56 of encircling panel 30. Zipper 70 releasably attaches right edge 34 of front panel 28 to first edge 56 of encircling panel 30, to, in turn, attach a portion of front panel 28 to encircling panel 30.

Second releasable attaching means 48 comprises second zipper 75 having first set of teeth 77 and second set of teeth 79. First set of teeth 77 of second zipper 75 are attached to left edge 36 of front panel 28. Second set of teeth 79 of second zipper 75 are attached to second edge 58 of encircling panel 30, and matingly correspond to first set of teeth 77 of second zipper 75. Zipper 75 releasably attaches left edge 36 of front panel 28 to second edge 58 of encircling panel 30, to, in turn, attach another portion of the front panel to the encircling panel. Of course, other means for releasably attaching front panel 28 to encircling panel 30 have been contemplated, such as hook and loop fasteners, snaps, and/or buttons, among other common fasteners.

Padded member 32 is seen in FIGS. 1–3 as comprising padding 82 and outer layer of material 84. Padded member 32 is operably attached to the outer surface 64 of encircling panel 30. It is also contemplated that padded member 32 may be operably attached to inner surface 62 of encircling panel 30. Padded member 32 extends continuously from first edge 56 of encircling member 30 to second edge 58 of encircling member 30.

Further, padded member 32 extends downward from upper edge 66 of encircling member 30 to approximately mid-way between upper edge 66 and lower edge 68, 68'. However, it is also contemplated that it may extend downward a further distance to fully cover the lower body region. As such, padded member 32 covers a large portion of the right hip region 20, left hip region 22 and lower rear region 24. Padding 82 is preferably a soft foam member; however, other types of padding, including both uniform and non-uniform thicknesses are also contemplated. It is contemplated that padded member 32 may extend the entirety of encircling member 30, or that padded member 32 may only cover discontinuous regions of encircling member 30 to provide protection to only certain predetermined areas of patient 12.

Outer layer of material 84 (FIG. 3) covers the extent of padding 82, to enhance the durability of the padding 82. Outer layer of material 84 is preferably of a material which is resistant to the passage of fluid, to, in turn, protect padding 82 from the passage of water therethrough, and, the absorption of same. It is contemplated that various of other materials with good stain resistant capabilities and/or durability characteristics is also contemplated. Of course, padding 82 may be exposed to the environment, that is, padded member 32 may omit outer layer of material 84.

In operation, encircling panel 30 is, for example, for a bedridden patent, positioned under patient 12, to cover lower rear region 24. Front panel 28 is then placed over lower front region 26 of patient 12. Next, first and second attachment means 46 and 48, respectively are attached, to fully releasably join front panel 28 to encircling panel 30. Accordingly, the garment has been positioned and patient 12 is dressed. As can be seen, while wearing garment 10, the patient has the protection of padded member 32, to prevent injury to right hip 20, left hip 22 and lower rear region 24.

If it is necessary to have access to lower front region 26 of patient 12, first and second attachment means 46 and 48, respectively, may be partially disconnected, or fully disconnected and front panel 28 may be moved to expose lower front region 26. Likewise, if it becomes necessary to fully remove garment 10, attachment means 46 and 48 are manipulated to fully disconnect. Subsequently, front panel 28 is detached and moved away from the patient's lower front region. Encircling panel 30 should then essentially fall away from the patient. Even if the patient is bedridden, once first and second attachment means 46 and 48, respectively, are manipulated to disconnect front panel 28 from encircling panel 30, it is only necessary to alter the position of the patient enough to slide encircling panel 30 away from lower rear region 24.

The foregoing description and drawings are merely to explain and illustrate the invention and the invention is not limited thereto except insofar as the appended claims are so limited, as those skilled in the art who have the disclosure before them will be able to make modifications and variations therein without departing from the scope of the invention.

What I claim is:

1. A lower body garment apparatus for a patient, having a lower region between the waist and the thigh of said patient, said lower region including at least one of a right and a left hip region, and further including a lower rear region and a lower front region, said lower body garment apparatus protecting said lower region of said patient while facilitating dress, undress and accessibility to the lower region of said patient with minimal movement and reorientation of said patient, to, in turn, minimize the risk of trauma and injury to said patient, said lower body garment apparatus comprising:

a front panel having a right edge, a left edge, a top edge, and a bottom edge, said front panel configured to cover at least a portion of said lower front region of said patient;

an encircling panel having a first edge, a second edge, an inner surface, an outer surface, an upper edge and a lower edge, said encircling panel extending around at least a portion of each of said at least one right and left hip regions, and further extending around at least a portion of said lower rear region of said patient and around at least a portion of said lower front region of said patient;

first means for releasably attaching said right edge of said front panel to said first edge of said encircling panel, second means for releasably attaching said left edge of said front panel to said second edge of said encircling panel; and a substantially uniform padded member operably attached to at least a portion of at least one of said inner and outer surfaces of said encircling panel so as to provide padding for substantially the entirety of the left and right hip regions and at least a portion of said lower rear region and said lower front region.

2. The apparatus according to claim 1 wherein:

said front panel further comprises an inner leg edge region; and said encircling panel further comprises a third edge region.

3. The apparatus according to claim 2 wherein:

said inner leg edge region of said front panel is operably attached to said third edge region of said encircling panel to define a crotch region.

4. The apparatus according to claim 1 wherein said top edge of said front panel is aligned and registered with said upper edge of said encircling panel, one of said top edge of said front panel and said upper edge of said encircling panel includes an elastic member associated therewith for facilitating a comfortable fit of said apparatus around said waist of said patient.

5. The apparatus according to claim 1 wherein said top edge of said front panel and said upper edge of said encircling panel are oriented for alignment with said waist of said patient.

6. The apparatus according to claim 5 wherein one of said top edge of said front panel and said upper edge of said encircling panel further comprises an elastic member associated therewith for facilitating a comfortable fit of said apparatus around said waist of said patient.

7. The apparatus according to claim 1 wherein said padded member is operably attached to said outer surface of said encircling panel and said padded member extends continuously from said first edge of said encircling panel to said second edge of said encircling panel so as to provide padding to said at least one right and left hip regions, and at least a portion of said lower rear region.

8. The apparatus according to claim 1 wherein said padded member is operably attached to said inner surface of said encircling panel and said padded member extends continuously from said first edge of said encircling panel to said second edge of said encircling panel so as to provide padding to said at least one right and left hip regions, and at least a portion of said lower rear region.

9. The apparatus according to claim 1 wherein said padded member extends from said upper edge of said encircling panel to substantially mid-way between said upper edge and said lower edge of said encircling panel.

10. The apparatus according to claim 1 wherein said padded member further includes an outer layer of material covering at least a portion of said padded member for operably restraining and enhancing the durability of said padded member, and, in turn, said lower body garment apparatus.

11. The apparatus according to claim 10 wherein said outer layer of material comprises a fabric which resists the absorption of fluids therethrough, to minimize the exposure to and absorption of such fluids by said padded member.

12. The apparatus according to claim 1 wherein said first releasable attachment means comprises a first zipper having a first set of teeth attached to said right edge of said front panel and a second set of teeth matingly corresponding to said first set of teeth, said second set of teeth attached to said first edge of said encircling panel, to facilitate attachment and detachment of said front panel from said first edge of said encircling panel.

13. The apparatus according to claim 1 wherein said second releasable attachment means comprises a second zipper having a first set of teeth attached to said left edge of said front panel and a second set of teeth matingly corresponding to said first set of teeth, said second set of teeth attached to said second edge of said encircling panel, to facilitate attachment and detachment of said front panel from said second edge of said encircling panel.

* * * * *